US008062079B2

(12) United States Patent
Hoppmann

(10) Patent No.: US 8,062,079 B2
(45) Date of Patent: Nov. 22, 2011

(54) CONNECTOR CLAMP WITH OPENING UNIT

(75) Inventor: Ralph Hoppmann, Bad Oeynhausen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 12/738,988

(22) PCT Filed: Oct. 27, 2008

(86) PCT No.: PCT/EP2008/009060
§ 371 (c)(1),
(2), (4) Date: May 28, 2010

(87) PCT Pub. No.: WO2009/053105
PCT Pub. Date: Apr. 30, 2009

(65) Prior Publication Data

US 2010/0311263 A1 Dec. 9, 2010

(30) Foreign Application Priority Data

Oct. 26, 2007 (DE) ..... 10 2007 051 697

(51) Int. Cl.
*H01R 4/48* (2006.01)

(52) U.S. Cl. ..... 439/834; 439/835

(58) Field of Classification Search ..... 439/834, 439/835

See application file for complete search history.

(56) References Cited

U.S. PATENT DOCUMENTS

| | | | | |
|---|---|---|---|---|
| 6,682,364 | B2 | 1/2004 | Cisey | |
| 6,689,955 | B2 | 2/2004 | Doutaz | |
| 7,004,781 | B2 | 2/2006 | Walter | |
| 7,097,497 | B2 | 8/2006 | Kikuchi | |
| 7,249,963 | B2 * | 7/2007 | Ramm et al. | 439/437 |
| 7,510,448 | B2 * | 3/2009 | Eppe et al. | 439/835 |
| 7,607,956 | B2 * | 10/2009 | Lang et al. | 439/835 |
| 2008/0020628 | A1 | 1/2008 | Kikuchi | |
| 2010/0173531 | A1 | 7/2010 | Holste | |

FOREIGN PATENT DOCUMENTS

DE 8704494 U1 6/1987

(Continued)

OTHER PUBLICATIONS

Abstract of EP1355380; Oct. 22, 2003.
International Search Report, PCT/EP2008/009060, dated Jan. 21, 2009, 4 pages.
Abstract of DE3302372; Dec. 6, 1990.
Abstract of DE20301369; Apr. 10, 2003.
Abstract of EP0303818; Feb. 22, 1989.
Abstract of EP0955692; Nov. 21, 2001.

*Primary Examiner* — Tho D Ta
(74) *Attorney, Agent, or Firm* — Senniger Powers LLP

(57) ABSTRACT

The invention relates to a connector clamp having a housing and a current bar disposed thereon, and having a receiving unit for receiving a conductor, and having a clamping unit with a clamping spring held in the housing for clamping the conductor against the current bar in order to conduct an inserted conductor to the current bar in an electrically conductive manner. An activation unit is provided that acts on the clamping spring in order to open the clamping unit. The activation unit is provided with an indicator unit for indicating a clamping state of the clamping unit. The activation unit is coupled in terms of movement to the clamping unit. The receiving unit is disposed spatially between a fixed section of the clamping spring and the activation unit so that the indicator unit indicates the clamping state of the clamping unit independently of the spatial position of the housing.

16 Claims, 2 Drawing Sheets

FOREIGN PATENT DOCUMENTS

| | | | |
|---|---|---|---|
| DE | 3302372 | C2 | 12/1990 |
| DE | 29807956 | U1 | 7/1999 |
| DE | 20301369 | U1 | 4/2003 |
| EP | 0303818 | A2 | 2/1989 |
| EP | 0955692 | B1 | 11/2001 |
| EP | 1355380 | A1 | 10/2003 |

* cited by examiner

CONNECTOR CLAMP WITH OPENING UNIT

REFERENCE TO RELATED APPLICATION

This application claims priority to Germany application 10 2007 051 697.7 filed Oct. 26, 2007.

FIELD OF THE INVENTION

The present invention relates to a connector clamp with an opening unit.

BACKGROUND OF THE INVENTION

Connector clamps with opening units which are used, in particular, to ensure a secure connection of flexible conductors in the connector clamp have become known in the prior art. To accomplish this, with a flexibly embodied conductor, for example, a tool is used in the connector clamp to allow the conductor to be reliably plugged into the connector clamp, where the conductor is held securely once actuation of the opening unit has ended, producing a secure electrical connection.

Clamps that have a status indicator for indicating the status of a plugged-in conductor have also become known in the art.

One disadvantage of the prior art is that when an opener is provided, there is no status indicator, and when the status indicator is provided, there is no opener.

A connector clamp for circuit boards is known from DE 10 2006 014 646 A1, for example, which has a pusher element made of plastic for opening the clamping position. A separate status indicator is not provided in this prior art document. In certain mounting situations, it is possible to read from the pusher element whether a conductor is held in place at the clamping point. However, if the mounting situation of the connector clamp is of this type, the position of the pusher element provides no indication as to the clamp status. The position of the pusher element is not representative of clamp status, for example, in an overhead mounting, as in that case the pusher element is not moved back to its normal position by the force of gravity. However, even with an arrangement on a vertical circuit board, it is not guaranteed that the pusher element will reliably indicate the clamp status. The disadvantage of this prior art is that no reliable indication of clamp status is provided.

A connector clamp is also known from U.S. Pat. No. 6,682,364 B2, in which an opener for opening the clamp connection is provided. The opener is coupled with the clamp spring, so that even with mounting on a vertical rail or with overhead mounting, the position of the pusher element generally acts as an indicator of clamp status. One disadvantage of this prior art, however, is that the path difference between the opened and closed positions of the opener is small, so that the status can be reliably identified only by a careful inspection from a short distance.

SUMMARY OF THE INVENTION

It is therefore the object of the present invention to provide an improved connector clamp, in which the clamp status is clearly indicated via simple means, regardless of the mounting position.

This object is attained with a connector clamp having the characterizing features of claim 1. Preferred modifications of the invention are the subject of the dependent claims. Additional advantageous characterizing features are specified in the description of the exemplary embodiment.

The connector clamp of the invention has a housing with a power terminal attached to it. Also provided on the housing is a receptacle for receiving at least one conductor. A clamp device having a clamp spring held in the housing clamps the conductor against the power terminal, thereby connecting a plugged-in conductor to the power terminal to allow the conduction of electrical power. An actuation device is provided for opening the clamping device. The actuation device acts on the clamp spring to open the clamp device. The actuation device is equipped with an indicator device for indicating the clamp status of the clamp device. The actuation device is motion-coupled to the clamp device. In addition, the receptacle is spatially situated between a fixed section of the clamp spring and the actuation device, so that the indicator device will indicate the clamp status of the clamp device on an enlarged scale, regardless of the spatial positioning of the housing.

The connector clamp of the invention has many advantages. One substantial advantage is that the actuation device for opening the clamp device is equipped with an indicator device, which indicates the clamp status of the clamp device. In this manner, faulty insertions of conductors into the connector clamp can be prevented, because the user is able to visually assess the result of the plug-in operation immediately after insertion, or at any later time. The indicator device indicates the clamp status reliably and reproducibly. The position of the indicator device can also be read from greater distances. This is due to the motion coupling of the actuation device with the clamp device, combined with the enhanced transfer of motion of the clamp device to the indicator device.

The invention is advantageous, in particular, because the clamp status of the clamp device is indicated regardless of the spatial positioning of the housing. Because connector clamps are mounted in the widest range of spatial positions, a connector clamp is only marginally useful, under certain circumstances, if the status indicator is position dependent. The position independence of the invention is achieved by equipping the actuation device with the indicator device, and, in particular, by configuring the two as a single piece. The enhanced scale of the transfer enables a significantly improved indication of the clamp status, which enables a significant status indication even with conductors having a small external diameter.

According to the invention, the actuation device can be used directly as an indicator device, because the clamp device transfers the current motion status to the actuation device in an enhanced fashion, so that the indicator device provided there indicates the status of the clamp on an enlarged scale via the motion coupling.

This type of embodiment offers considerable advantages, as the device can be implemented with a very small structure. In contrast, if a separate actuation device and a separate indicator device are integrated into a connector clamp, this requires a substantial amount of space, which is typically not available in connector clamps. The space requirement of connector clamps is important because only a limited amount of space is available on the mounting rails, etc.

The receptacle is preferably located in a central area, in particular, approximately centered in the housing.

The clamp spring is advantageously embodied as a leg spring. The clamp spring or leg spring is preferably provided as pivotable about a point of rotation on the fixed section of the clamp spring, on one side of the receptacle in the housing. The actuation device is then situated on the other or opposite side of the receptacle in the housing.

In one embodiment of the invention, the actuation device is rigidly connected to the clamp device, so that any movement of the clamp device is transferred to the actuation device.

In advantageous modifications, the actuation device is flexibly connected to the clamp device. This comprises the case, in particular, in which the actuation device must first execute a certain linear movement before the movement of the actuation device is transferred to the clamp device.

In advantageous modifications, the actuation device comprises a pusher element, the position of which serves as the indicator of the indicator device. In this embodiment, a particularly simple structure and one that requires a particularly small amount of space is enabled, as the pusher element serves as the actuation device for releasing a conductor in the connector clamp, while at the same time, the position of the pusher element indicates the status of the clamp device.

In particularly preferred embodiments, the clamp device comprises a clamp spring, embodied, in particular, as a leg spring. A status indicator makes sense, in particular, if leg spring clamps are used, because this allows a faulty plug-in due to insertion to an insufficient depth to be avoided. In particular, the clamp spring is motion-coupled with the pusher element.

In advantageous modifications, the clamp spring has a window, which is suitable, in particular, for accommodating a conductor. For example, the clamp spring can have a window through which the conductor inserted into the connector clamp can be guided, with the inserted conductor then being held in place, clamped by the clamp spring. This means that the clamp spring or the window of the clamp spring rests against the conductor to be held in place, thereby allowing a conclusion to be drawn as to whether or not the conductor is secured based upon the position of the clamp spring.

In advantageous modifications, the clamp spring engages in an opening, in particular, in a groove of the pusher element. This means that when the pusher element is actuated, not only is the pusher element moved, but the clamp spring also changes its position correspondingly. In this manner, the clamp connection between clamp spring, conductor and power terminal can be released, allowing the conductor to be removed or inserted.

The pusher element is preferably prestressed in a normal position with a prestressing device. The prestressing device is embodied, in particular, as a spring, which is preferably structured as a single component with the pusher element. For example, the prestressing device can be embodied as a spring, which is injection-molded onto the pusher element during production.

In preferred modifications, the indicator device is suitable for indicating the accommodated line cross-section. This is ordinarily the case, for example, when the information about the inserted conductor is determined via the clamp device, because the clamp device is displaced less by a small line cross-section than by a larger line cross-section.

In preferred modifications of the invention, a clamping pad can be provided, which is situated in the receptacle and is motion-coupled with a position of a conductor. This can be accomplished, for example, by the clamping pad covering the entire cross-section of the receptacle, so that a conductor inserted into the receptacle forces the clamping pad to move along when the conductor is inserted.

The clamping pad preferably passes its change in position on to the pusher element or to the prestressing device or spring provided on it, so that when the clamping pad moves, the pusher element is also moved, thus the pusher element or its position then serves as the indicator device.

With a clamping pad, a status indicator is achieved which is independent of the line cross-section of the plugged-in conductor. A further substantial advantage of a clamping pad is that the insertion depth of the conductor can be determined directly. If, in contrast, the conductor is plugged into a window of the clamp spring, the clamp leg of the clamp spring is displaced only when the conductor has actually been received, however the insertion depth of the conductor cannot be easily indicated or determined. This is not the case when a clamping pad is used, as the insertion depth of a conductor can be determined directly via the position of the clamping pad.

In a further preferred modification of the invention, the actuation device is equipped with a carrier and with a hinge, wherein a conductor plugged into the receptacle carries the carrier with it, displacing the pusher element via the hinge, so that the pusher element indicates the status of a plugged-in conductor. To release the clamp connection, the pusher element can be actuated such that an actuation area of the pusher element presses on a spring leg of the clamp spring, which then releases the clamping of the conductor against the power terminal, so that in this embodiment as well, a combined indicator and pusher element apparatus is provided.

Advantageously, an open space is provided between the pusher element and the clamp spring, so that the clamp spring is opened by the pusher element only after the pusher element has been displaced by a measurement of the open area, which is particularly preferably dimensioned such that the pusher element reaches the proper position for indication without actuating the leg spring and opening the contact, even when the smallest line cross-section is provided or accommodated.

In preferred embodiments, the pusher element projects beyond the housing when a conductor has been correctly plugged in. In another preferred embodiment, the pusher element enters the housing when a conductor has been properly received.

Additional advantages and characterizing features of the present invention are found in the description of the exemplary embodiment, which will be specified in greater detail in what follows, in reference to the attached set of diagrams.

BRIEF DESCRIPTION OF THE FIGURES

The diagrams show.

DETAILED DESCRIPTION OF PREFERRED EMBODIMENTS

Figure 1:
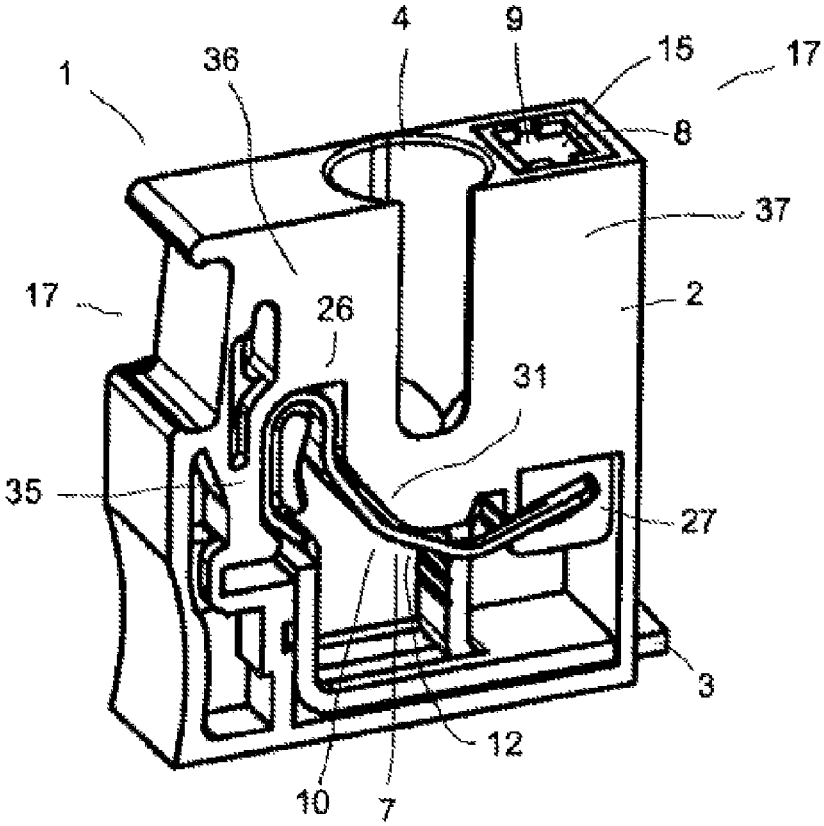
FIG. 1 a first exemplary embodiment of the connector clamp of the invention in its normal position.

This application claims priority to Germany application 10 2007 051 697.7 filed Oct. 26, 2007, the entire disclosure of which is incorporated by reference.

An exemplary embodiment of the present invention will now be described with reference to the attached FIGS. 1 through 4.

The connector clamp 1 of the invention, illustrated in FIGS. 1 through 4, comprises a housing 2 and a power terminal 3 arranged on or in this. A centered opening serves as a receptacle 4, for inserting a conductor 5 with a small cross-section or a conductor 6 with a large cross-section into the housing 2 of the connector clamp 1. A clamp device 7, which comprises a clamp spring 10 embodied here as a leg spring 11, creates the clamping connection of the plugged-in conductor 5 or 6 with the power terminal 3.

FIG. 1 illustrates the normal status 17, in which here, the indicator 9 terminates flush with the upper edge of the housing. At the same time, the indicator 9 serves as pusher element 15 of the actuation device 8, in order to enable a secure clamping and later a safe reopening of the clamp device, for example with flexible conductors, to allow the conductor to be plugged in or removed from the connector clamp 1 without becoming damaged.

The actuation device 8 serves at the same time as indicator device 9, so that the position of the pusher element 15 is an indicator of the clamp status. If the pusher element 15 is flush with the upper side of the housing 2, then no conductor is plugged into the receptacle 4, or the conductor is plugged only very insecurely into the receptacle 4.

The receptacle 4 is located in a central area 34, in which it is approximately centered in the housing 2.

The clamp spring 10, embodied as leg spring 11, is configured as pivotable about a point of rotation 26 on the fixed section 35 of the clamp spring 10 on the one side 36 of the receptacle 4 in the housing 2. The actuation device 8 is then positioned on the other or opposite side 37 of the receptacle 4 in the housing 2.

This configuration allows a movement of the clamp spring 10 to be transferred in an enhanced fashion to the actuation device 8 that serves as the indicator device 9. A conductor plugged into the receptacle 4 acts in a center area between the rotational point 26 and the end 27 of the clamp leg 38 of the leg spring 11 such that the end 27 is displaced a substantially greater distance, in accordance with the lever principle. The degree of enhancement can be adjusted by adjusting the leverage ratios. Thus a thin conductor that is clamped in the receptacle 4 will ensure a reliable indication of the clamp status.

Figure 2:
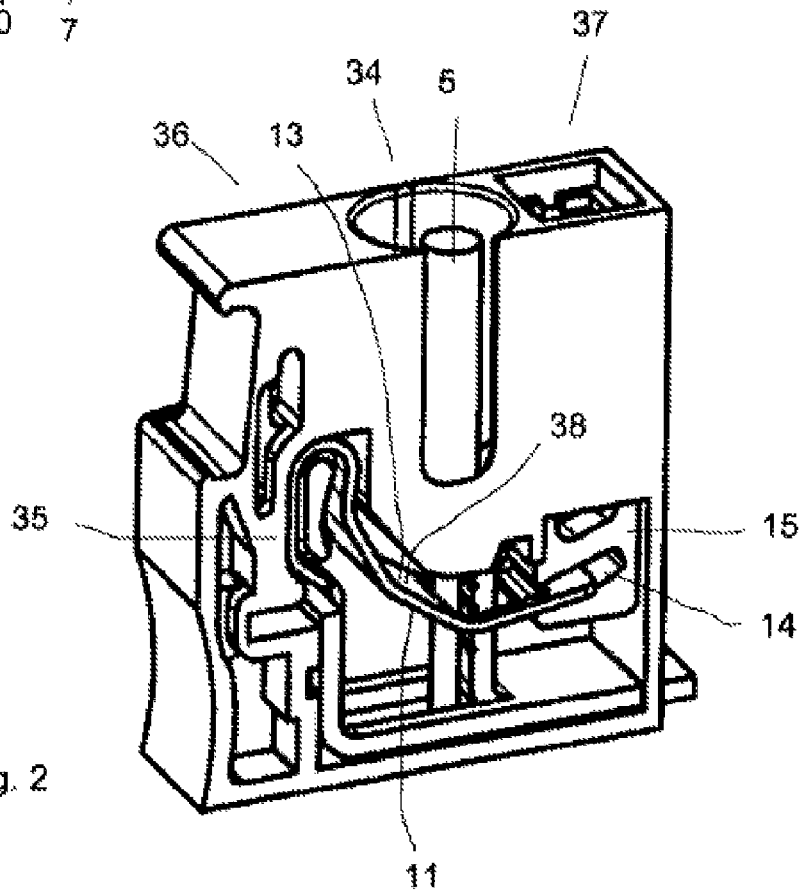
FIG. 2 the connector clamp of FIG. 1 with a plugged-in conductor with a small line cross-section.

FIG. 2 illustrates the status in which a conductor 5 having a small cross-section is held properly in the receptacle 4 and reliably pressed by the leg spring 11 against a part of the power terminal 3. Here in the exemplary embodiment, the leg spring 11 on the clamp leg 38 is equipped with a window 12, through which the conductor 5 passes during the clamping connection. The approximately rectangular window 12 permits the accommodation of conductors of different diameters.

On one side of the window 12, namely on the power terminal or on the contact point with the side that is opposite the power terminal, the clamp edge 13 is provided, with which the leg spring 11 presses the conductor 5 against a part of the power terminal 3, in order to produce a conductive contact with the power terminal.

Here, in the exemplary embodiment, the receptacle 4 is located in a central area of the housing 2, so that the point of rotation 26 of the leg spring 11 is located on the one side of the receptacle 4, while the actuation device 8 is located on the opposite side. The result is that the end 27 of the clamp spring 11 that dips into an opening 14 in the pusher element 15 is located a maximum distance from the point of rotation 26 of the clamp spring, resulting in an enhancement of the displacement exerted by the plugged-in conductor on the clamp spring. This enables a clearly visible displacement of the pusher element 15 or the indicator device 9 even when conductors having a thin cross-section are plugged in, so that a reliable assessment of the clamp status is possible even with conductors 5 having a small cross-section.

Figure 3:
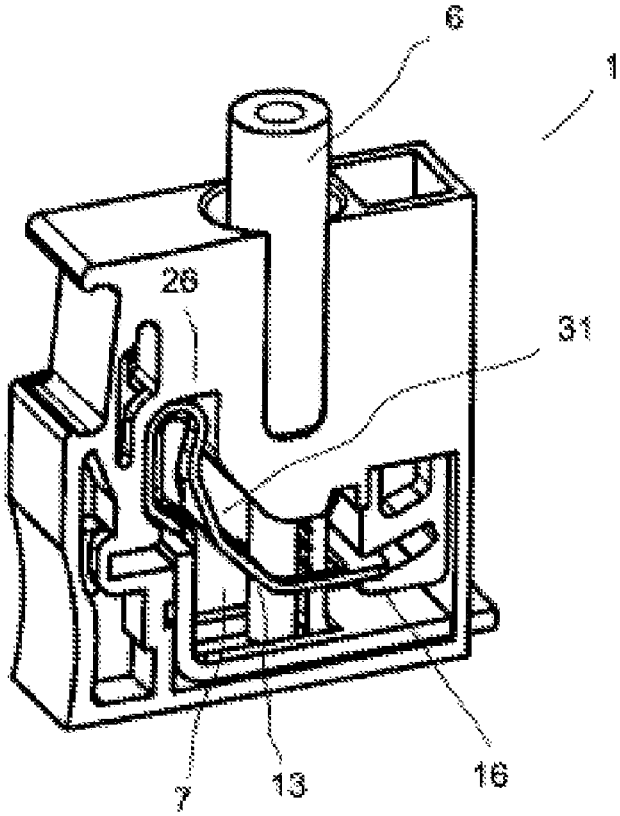
FIG. 3 the connector clamp of FIG. 1 with a plugged-in conductor with a large line cross-section.

FIG. 3 shows the status of the connector clamp 1 holding a conductor 6 with a larger cross-section. In this case, the indicator device 9 is displaced a greater distance.

Figure 4:
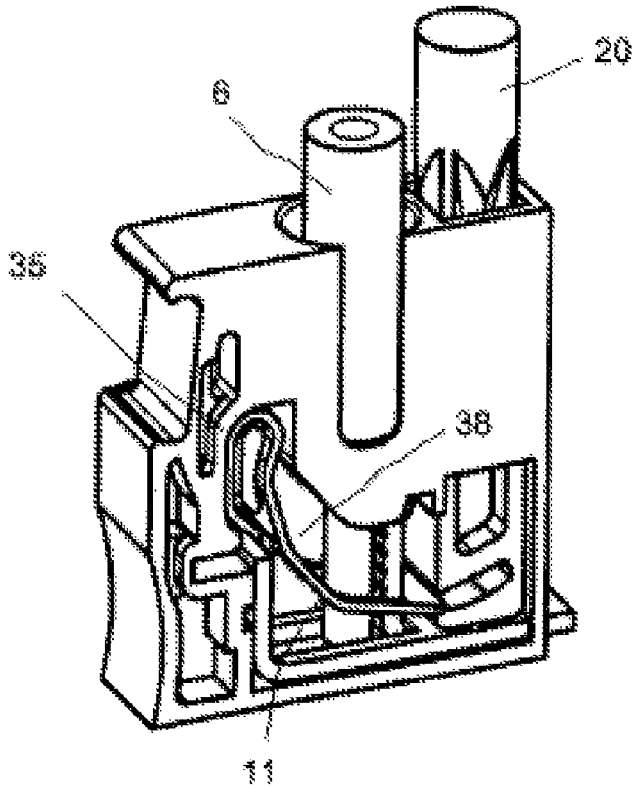
FIG. 4 the connector clamp of FIG. 1 with actuation of the opener.

FIG. 4 shows the connector clamp 1 with the tool 20 inserted, with the pusher element 15 displaced maximally by the tool 20. Because the end 27 of the leg spring 11 is dipped into the opening 14 in the pusher element 15, which is especially embodied as a groove, the leg spring 11 is also moved along by the dipping movement of the pusher element 15, causing the end 27 of the leg spring to pivot about the point of rotation 26 and thereby release the previously clamped conductor 6, which can then be pulled out without contact with the window 12 in the leg spring 11.

Here, in the exemplary embodiment, in the normal status 17 the pusher element 15 extends beyond the upper side of the housing 2, whereas when the conductor is inserted correctly, the pusher element 15 is aligned flush with the surface of the housing 2.

In contrast to the illustrated exemplary embodiment, in further embodiments the status indication can be formed independently of the diameter of the inserted conductor. Regardless of whether a conductor 5 with a small diameter or a conductor 6 with a larger diameter is inserted into a corresponding receptacle 4, in corresponding embodiments and with the proper insertion, the same status of the clamp status indicator or indicator device 9 can result.

Here in the exemplary embodiment, in the normal status 17 the pusher element 15 projects beyond the upper side of the housing 2, whereas when the conductor is inserted properly, the pusher element 15 is aligned flush with the surface of the housing 2.

It is also possible for the pusher element 15 to terminate flush with the surface in the normal status 17 and to dip into the housing 2 when the conductor is properly connected.

In preferred embodiments, a pusher element can be provided in the housing 2, which has a contact surface for contact with the conductor 5 or 6 to be inserted and has a transfer element and a carrier.

The pusher element can be embodied such that the contact piece essentially covers the entire cross-section of the receptacle 4, so that when a conductor 5 or 6 is inserted into the receptacle 4, the contact piece must be carried along by the conductor in the insertion direction.

This translational motion is transferred to the carrier via the transfer element. The carrier is in contact with a rib, which is especially part of a prestressing device 16 embodied as a spring. Thus when a conductor 5 or 6 is inserted into the receptacle 4, the clamping pad is displaced against the force of the prestressing device 16.

Because the prestressing device 16 is especially embodied as a single piece with the pusher element 15, and in any case is securely connected to it, when a conductor 5 or 6 is inserted into the receptacle 4, the pusher element 15 and thus also the indicator 9 are displaced the distance of the insertion depth as soon as the inserted conductor 5 or 6 comes into contact with the clamping pad. The clamping pad is advanced to the maximum depth, so that the indicator movement of the pusher element 15 results from the corresponding insertion depth.

The clamp device 7 of the connector clamp 1 is opened by actuating the pusher element 15 with a tool 20. The pusher element 15 is pushed down by the tool 20 into the housing and, after executing a translational movement through the open space, reaches the contact area on the contact leg 31 of the leg spring 11. With further translational movement by the tool 20, the contact area presses the contact leg 31 out of the contact position, and the clamp status is released, so that the inserted conductor 5 or the inserted conductor 6 can be easily removed from the connector clamp 1 or, conversely, can be inserted into the receptacle 4 of the connector clamp 1.

LIST OF REFERENCE SYMBOLS

1 Connector clamp
2 Housing
3 Power terminal
4 Receptacle
5 Conductor
6 Conductor
7 Clamp device
8 Actuation device
9 Indicator device
10 Clamp spring
11 Leg spring
12 Window
13 Clamp edge
14 Opening
15 Pusher element
16 Prestressing device
17 Normal position
20 Tool
26 Point of rotation
27 End of clamp spring
28 Contact surface
31 Contact leg
34 Central area
35 Fixed section
36 One side
37 Other side
38 Clamp leg

The invention claimed is:

1. Connector clamp comprising:

a housing;

a power terminal attached to the housing;

a receptacle for accommodating at least one conductor;

a clamp device with a clamp spring held in the housing for clamping the conductor against the power terminal, in order to connect a plugged-in conductor to the power terminal in an electrically conductive fashion;

an actuation device which acts on the clamp spring to open the clamp device;

wherein actuation device is equipped with an indicator device for indicating the clamp status of the clamp device;

wherein the actuation device is motion-coupled to the clamp device, and the receptacle is spatially arranged between a fixed section of the clamp spring and the actuation device, so that the indicator device indicates the clamp status of the clamp device in an enlarged scale, independently of the spatial positioning of the housing; and wherein the actuation device can be actuated only via a tool, which can be inserted into the interior of the housing, with such actuation allowing the conductor to be inserted into or removed from the connector clamp.

2. The connector clamp of claim 1, wherein the receptacle is located in a central area of the housing.

3. The connector clamp of claim 1, wherein a leg spring is provided as pivotable about a point of rotation on the fixed section of the clamp spring on the one side of the receptacle in the housing, and wherein the actuation device is located on the other side of the receptacle in the housing.

4. The connector clamp of claim 1, wherein the actuation device is rigidly connected to the clamp device.

5. The connector clamp of claim 1, wherein the clamp spring is equipped with a window for accommodating a conductor and wherein the clamp edge is provided on the window.

6. The connector clamp of claim 1, wherein the indicator device is capable of indicating a cross-section of an accommodated conductor.

7. The connector clamp of claim 1 wherein the actuation device is adapted such that its top is beneath the housing surface when a conductor is clamped in the housing, and the actuation device is adapted to be actuated by insertion of a tool into the housing to allow insertion of a conductor into the housing or release of a clamped conductor from the housing.

8. The connector clamp of claim 1, wherein the actuation device is flexibly connected to the clamp device.

9. The connector clamp of claim 8, wherein the clamp spring engages in an opening in the pusher element.

10. The connector clamp of claim 1, wherein the actuation device comprises a pusher element, the position of which serves as the indicator of the indicator device.

11. The connector clamp of claim 10, wherein the clamp spring engages in an opening in the pusher element.

12. The connector clamp of claim 10, wherein the pusher element is prestressed in a normal position via a prestressing device.

13. The connector clamp of claim 1, wherein the clamp spring comprises a clamp spring embodied as a leg spring with a clamp edge.

14. The connector clamp of claim 13, wherein the pusher element is prestressed in a normal position via a prestressing device.

15. The connector clamp of claim 8, wherein the pusher element is prestressed in a normal position via a prestressing device.

16. The connector clamp of claim 15, wherein the prestressing device and the pusher element form a single piece.

* * * * *